US005734993A

United States Patent [19]

D'Oca

[11] Patent Number: 5,734,993

[45] Date of Patent: Apr. 7, 1998

[54] HAT AND HAT PIN WITH SPORTS LOGOS

[76] Inventor: Gail P. D'Oca, 34 Hillside Ave., Glen Rock, N.J. 07452

[21] Appl. No.: 724,762

[22] Filed: Oct. 3, 1996

[51] Int. Cl.[6] ..... A42B 1/24

[52] U.S. Cl. ..... 2/175.3; 2/209.13; 2/244; 132/57.1; 132/60; 132/65.1; 132/68.1; D2/895; D11/207

[58] Field of Search ..... 2/175.3, 209.13, 2/244, 245, 246; 132/57.1, 60, 65.1, 68.1; D2/895; D11/47, 207

[56] References Cited

U.S. PATENT DOCUMENTS

| | | | |
|---|---|---|---|
| 909,467 | 1/1909 | Shaw | D11/47 |
| 1,387,694 | 8/1921 | Eaddy | 132/68.1 |
| 1,676,504 | 7/1928 | Risley | 2/175.1 |

*Primary Examiner*—Diana Biefeld

*Attorney, Agent, or Firm*—W. Patrick Quast, Esq.

[57] ABSTRACT

A woman's sports hat is disclosed. A pin configured to represent the sport the woman intends to play while wearing the hat is inserted through two openings at the front of the hat so as to secure the hat to the woman's head. The hat will then resist being blown off in the wind, or falling off during physical, sports related activity. To further relate the hat and sport together a logo representing the same sport as the sports pin is imprinted or otherwise affixed to one or both sides of the hat. Reversible hats and caps can have different logos on the inside and outside of the hat so that the hat can simply be turned inside out, and the appropriate sports pin inserted in order to make the hat suitable for different sports, as, for example, golf and tennis.

12 Claims, 5 Drawing Sheets

HAT AND HAT PIN WITH SPORTS LOGOS

BACKGROUND

This invention relates to women's hats, and in particular to hats often worn by women engaged in a sport such as golf or tennis.

Women have traditionally worn a virtually limitless variety of hats for either practical protection from weather, or as an enhancement apparel accessory, or as a combination of both reasons. A typical peaked cap, and a floppy rain hat, some of which are reversible so as to be able to be turned inside out, are ubiquitous head wear for a variety of sport related activities. A problem not ordinarily addressed in women's sports hats is the tendency for the cap or hat to blow off the wearer's head in windy weather or during intense physical activity. This results from the greater mass of hair normally possessed by women in contrast to the close cropped male head of hair. The traditional hat pin can, of course, be used to secure women's sports hats in place. However, the instant invention envisions utilizing two openings in the hat through which a sports pin, clearly identifying the sport being played in a distinctive and attractive manner, serves the double purpose of also securing the cap or hat in place.

It is therefore a primary object of the invention to provide a combination sports pin and sports hat for women.

A further object of the invention is to provide a series of sports pins, interchangeable with each other, denoting specific sporting endeavors in an attractive manner.

An additional objective of the invention is to provide a sports hat for women that is secured from easy removal by wind or intense physical activity.

Still another object of the invention is to provide a combination identifying sports logo and removable identifying sports pin on a woman's sports hat in order to both identify the sport being played in an attractive manner, and also at the same time to secure the sports hat to the woman's head.

A further object of the invention is to provide a reversible combination of sports logo and removable identifying sports pins so that a sports hat can be secured on a woman's head attractively depicting one sport, then reversed as required to denote a different sport.

SUMMARY

The above and related objects are obtained in the instant invention of a woman's sports hat.

As has been noted above, the traditional method for securing a woman's hat from blowing off in a wind or during physical activity has been the use of a hat pin. Today's woman, now wearing a typical peaked sports cap or floppy rain hat, usually forgoes this prior securing means and simply hopes for the best. It is the purpose of this invention to restore this amenity to women's sports hats in both a useful and attractive manner. For example, in the case of the peaked cap often worn while playing golf or tennis, two holes placed just above the peak of the cap, and located laterally adjacent and at a spaced distance from each other, provides the means for the placement of a pin through the first hole in the cap, then through a portion of the woman's hair, then out through the second hole in the cap, thereby securing the cap to the woman's head. Instead of the pin being a simple needle with enlarged head device, it is, for example, in the shape of a golf tee if the wearer of the cap intends to play golf. Or the sports pin can represent a miniature tennis racket if the woman intends to play tennis, and so on. Depending on the material the cap is made from, the holes in the cap for securing the sports pin can have a sewn edge, or a metal or plastic grommet can be attached within each hole.

In a further identification of the sport intended to be played while wearing the sports hat of the invention, a sport depicting logo, such as, for example, a golf ball sitting on a tee for golf, can be imprinted or otherwise affixed to either the left or right sides of the hat. In the case of a reversible hat, a second logo, as, for example, a miniature tennis racquet, can be shown on the inside of the hat, affixed to one or both sides. The sports hat can then be smartly representative of golf when the woman is playing golf, and simply turned inside out and a tennis sports pin affixed within the two openings in the hat to secure the hat to the woman's head while playing tennis, and doing so in an attractive, sports identifying manner.

While the sports hat of the instant invention has been described as a peaked cap or a floppy rain hat, obviously other styles of sports hats can be similarly equipped with the two openings for a suitable sports pin, and with a suitable sports identifying logo affixed to one or more sides of the hat.

DETAILED DESCRIPTION

Figure 1:
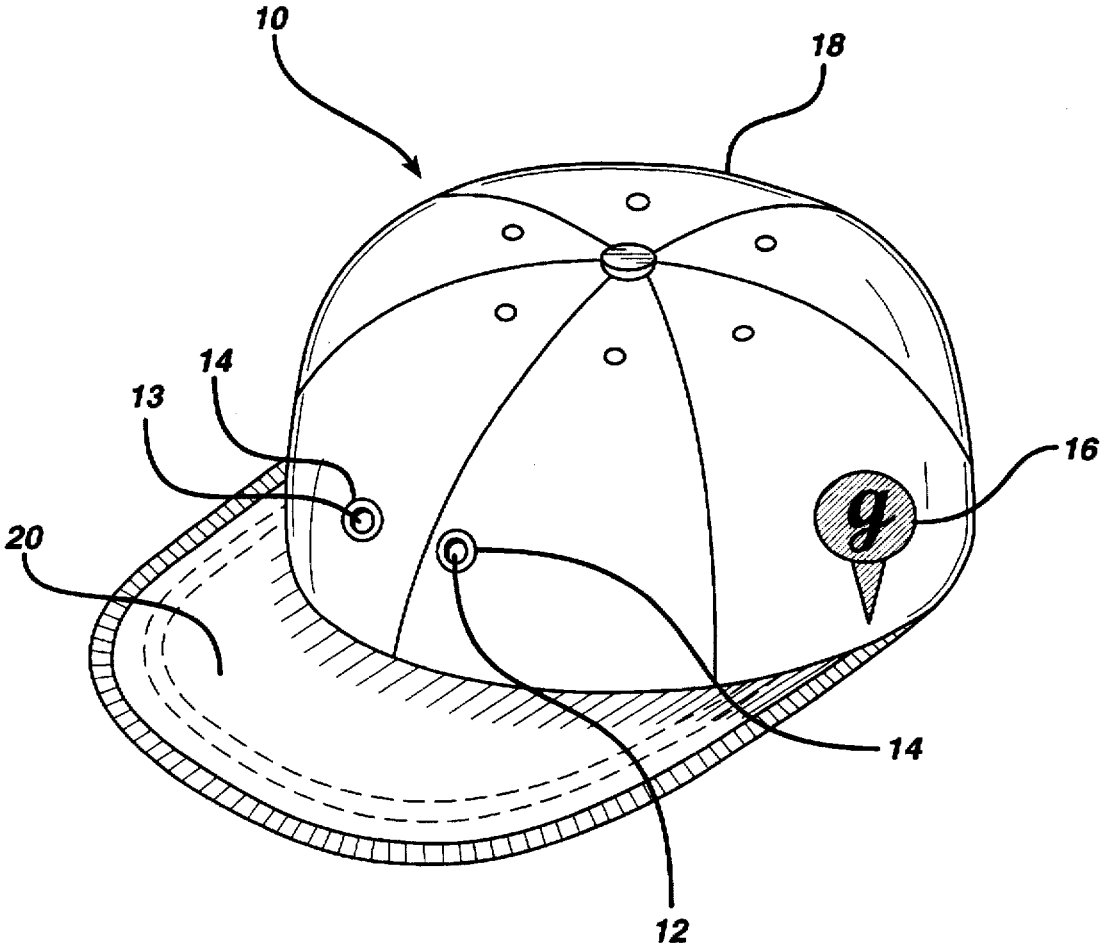
FIG. 1 is a perspective view of one version of the invention showing grommet secured holes and a golf logo in a peaked sports cap for women.

Referring now to the drawings in which similar structures having identical functions are identified with the same numerals throughout the several views, in FIG. 1 a version of the invention of a woman's sports hat is shown as being a peaked cap 10. The cap has a typical crown portion 18 and a brim portion 20. A pair of holes 12, 13 are placed a spaced distance apart from each other in substantially the same lateral plane. The edges of the holes 12, 13 are shown having been secured by the placement and crimping of a metal or plastic grommet 14 within each hole. The holes 12, 13 are preferably placed at what would normally be considered the front of the cap, and at a spaced distance above the balm of the cap. Depending on the type of material from which the cap 10 is made other methods for securing the edge of each of the two holes can be employed, such as, for example, sewing the edge of each hole so as to secure the integrity of the edge. Also shown in FIG. 1 is a logo 16 affixed to the side of the crown 18 of the cap. The logo 16, in this case, is a representation of a golf ball sitting on a tee in order to make the cap especially appropriate if the wearer intends to play golf. The logo can be affixed to one or both sides of the cap in a conventional manner such as imprinting the logo on the cap, adhesively affixing a logo to the side of the cap, and so on.

Figure 2:
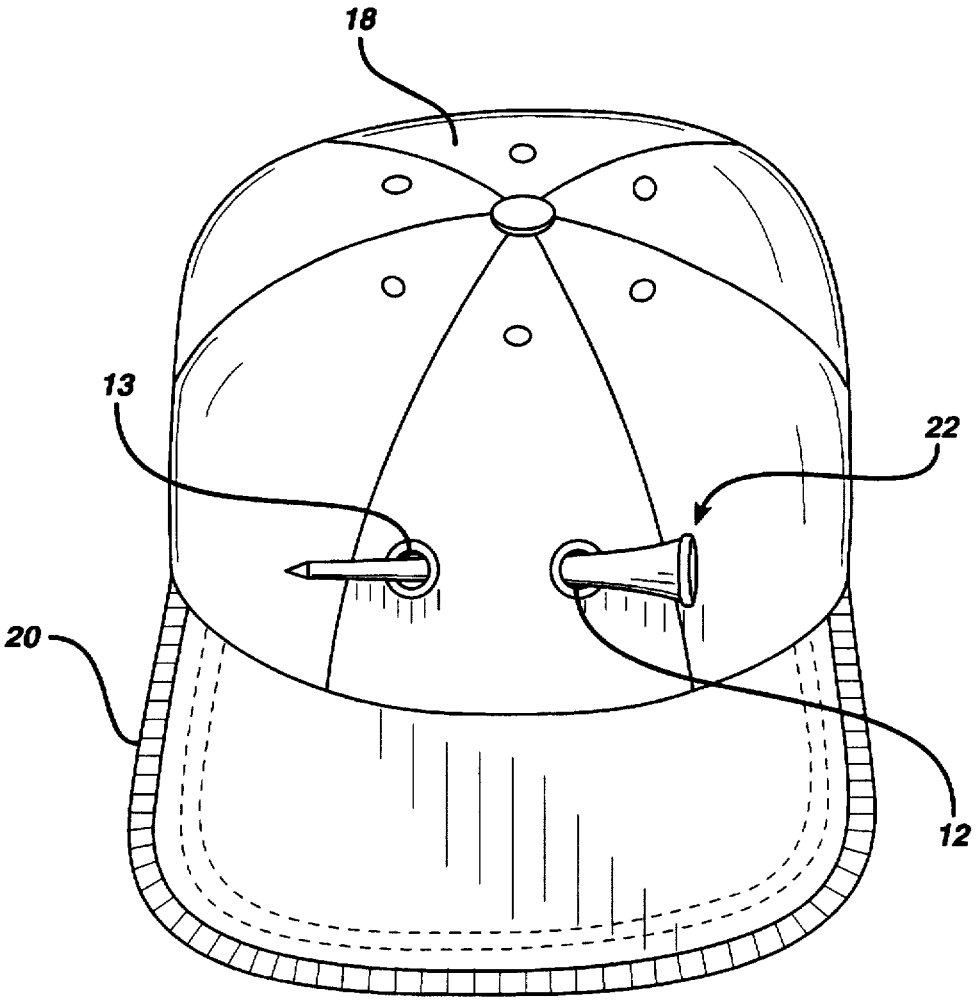
FIG. 2 is a perspective view of the version of the invention depicted in FIG. 1 showing a golf sports pin secured in operating position within the grommet secured holes in the peaked sports cap for women.

FIG. 2 illustrates placing a sports pin 22 within the first 12 of the two openings in the cap of FIG. 1 in such a manner as to capture a portion of the hair on the head of the woman wearing the cap 10, then pushing the sports pin out of the second hole 13 in the cap, thereby securing the cap to the wearer's head in windy conditions, and during physical activities associated with the sport to be played. In this case the sports pin 22 is in the form of a wooden or plastic golf tee in order to more fully carry out in a functional yet attractive manner the representation of the sport being played. At the same time the game of golf is symbolized as well by the logo 16 on the cap.

Figure 2A:
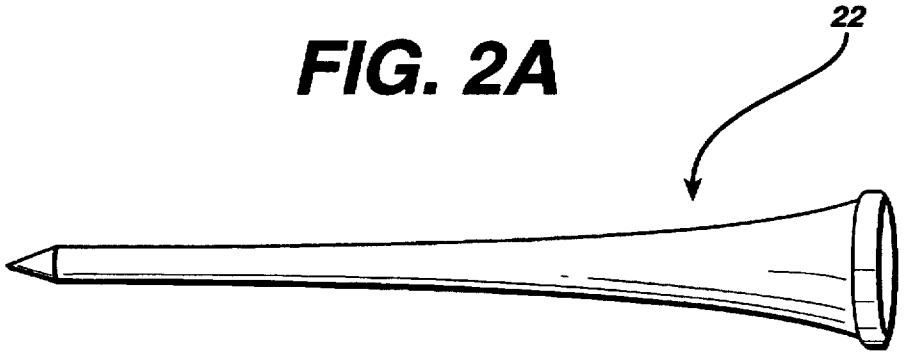
FIG. 2A illustrates a sports pin for golf, being in the form of a golf tee.
Figure 3:
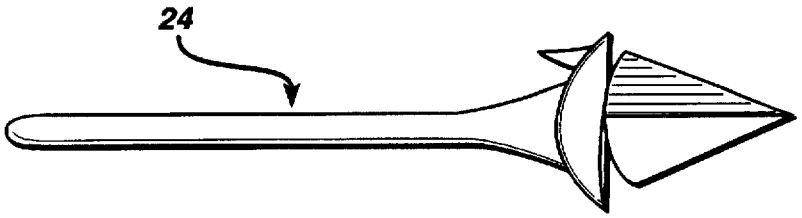
FIG. 3 illustrates a sports pin for sailing, having a sail boat representation.
Figure 4:
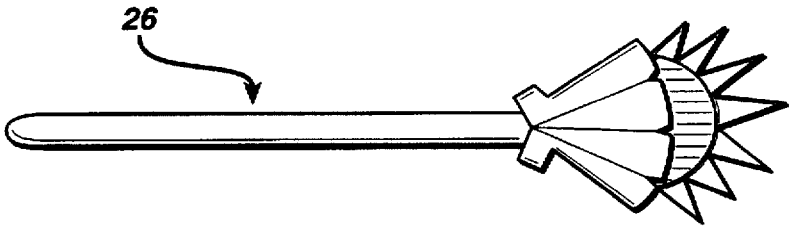
FIG. 4 illustrates a sports pin for beach activities, having a beach representation.
Figure 5:
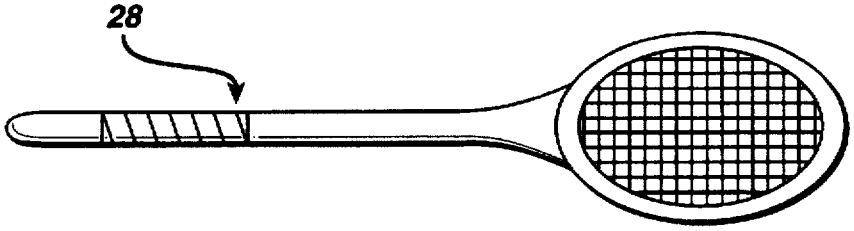
FIG. 5. illustrates a sports pin for tennis, having a tennis racquet representation.
Figure 6:
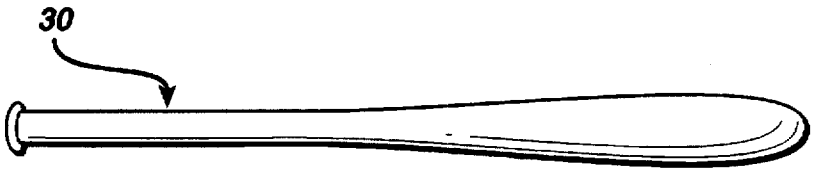
FIG. 6 illustrates a sports pin for baseball, having a baseball bat representation.
Figure 7:
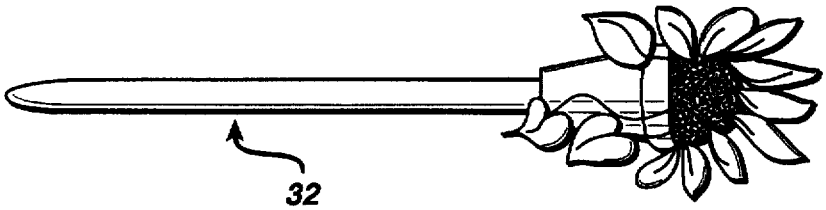
FIG. 7 illustrates a sports pin for gardening, having a floral representation.
Figure 8:
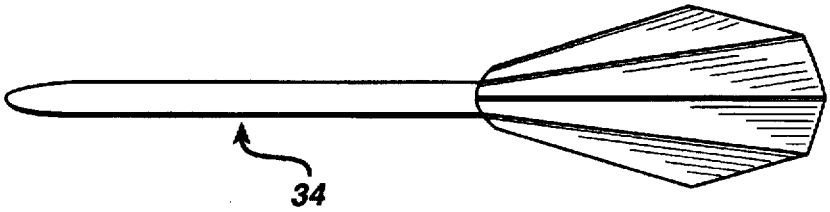
FIG. 8 illustrates a sports pin for boating, having an oar representation.
Figure 9:
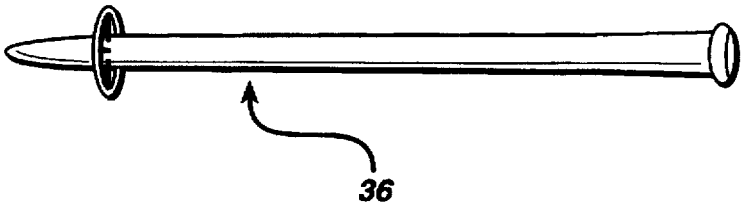
FIG. 9 illustrates a sports pin for skiing, having a ski pole representation.

FIGS. 2A–FIG. 9 illustrate a range of sports pins that can be functionally and decoratively applied for a number of outdoor and sports related activities. These sports pins can be fabricated in wood, plastic, or metal depending on cost factors for various markets. The sports pin 22 of FIG. 2A is a representation of a golf tee; the sports pin 24 of FIG. 3 has a miniature sail boat affixed to one end of a shaft so as to represent boating related activities; the sports pin 26 of FIG. 4 has a representation of a sunburst at one end of a shaft so as to indicate activities at a beach; the sports pin 28 of FIG. 5 has a miniature tennis racquet affixed at one end of a shaft; the sports pin 30 of FIG. 6 is in the shape of a miniature baseball bat for appropriate use while viewing a game of baseball; the sports pin 32 of FIG. 7 has a representation of a floral display at one end of a shaft symbolizing gardening activities; the sports pin 34 of FIG. 8 is in the shape of a miniature oar for appropriate use while boating; the sports pin 36 of FIG. 9 is a miniature ski pole suitable for the wearer while skiing. The above described sports pins are to clearly indicate the many potential applications of the instant invention, and are not meant to convey a complete list.

Figure 10:
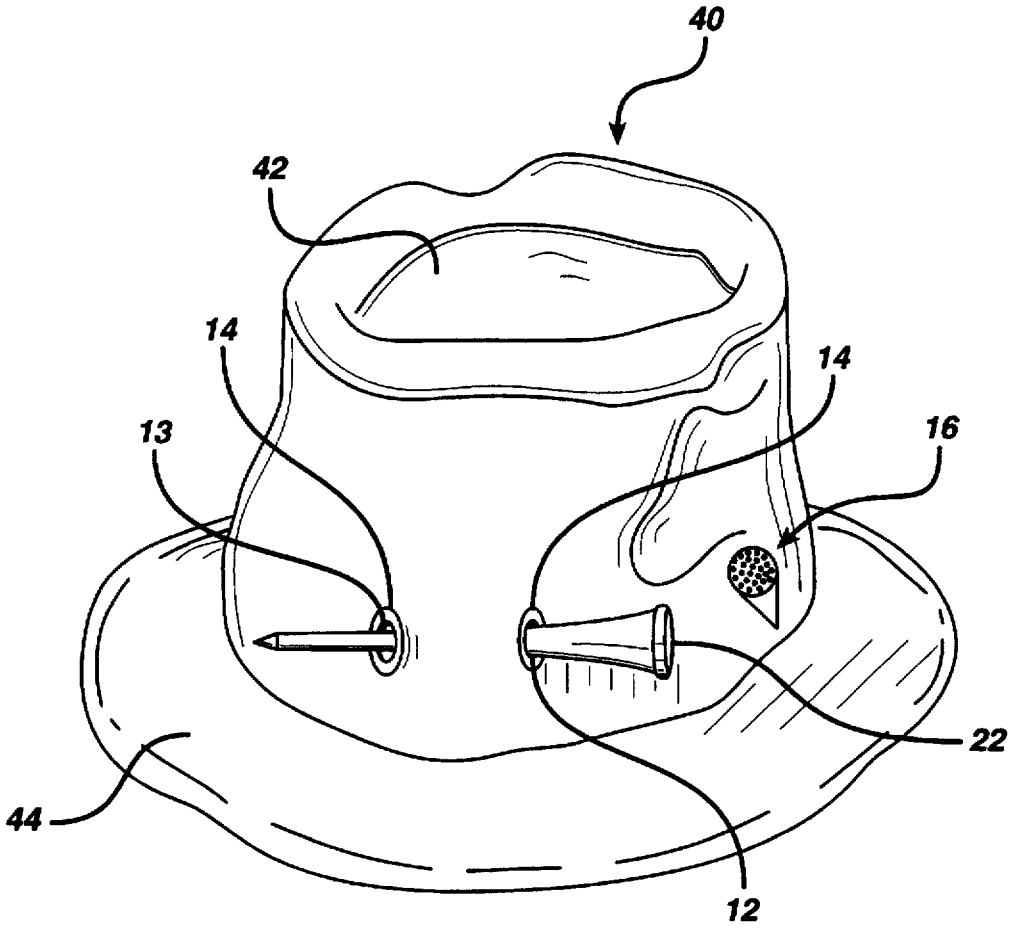
FIG. 10. is a perspective view of one version of the invention illustrating a floppy rain hat having a golf sports pin in place within the grommet secured holes adjacent the brim of the hat, with a golf logo imprinted on the side of the hat.
Figure 11:
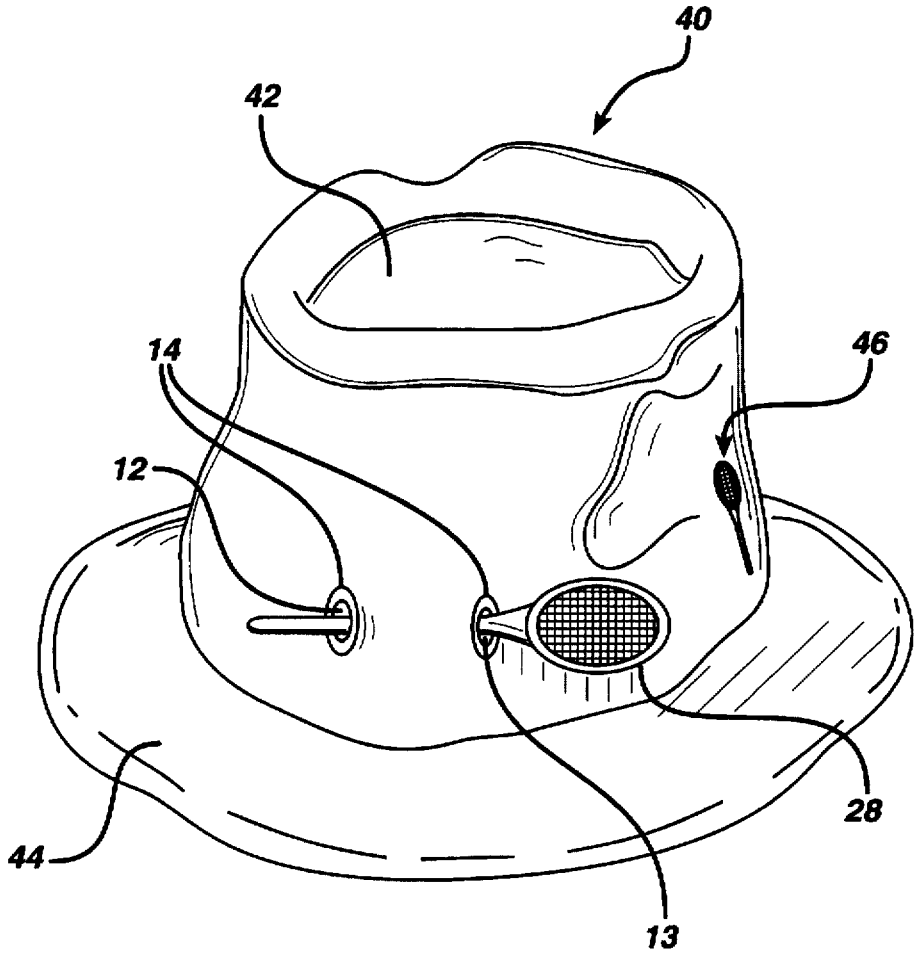
FIG. 11 is a perspective view of the version of the invention depicted in FIG. 10, showing the floppy rain hat turned inside out, with a tennis logo in the form of a tennis racquet imprinted in the side of the hat, and a tennis sports pin in place within the two grommet secured holes in the hat.

FIGS. 10 and 11 illustrate another important aspect of the invention. A reversible floppy rain hat 40 is shown having a typical crown portion 42 and brim portion 44. On a first side of the crown 42 a golf logo 16 (i.e. a golf ball sitting on a golf tee) is imprinted (FIG. 10), and when turned inside out a second side of the crown is shown as having a tennis logo 46 (i.e. a miniature tennis racquet). To compliment the golfing activities symbolized by the golf logo on the first side of the reversible hat the wearer would obviously use a golf sports pin 22 in order to secure her hair and cap together. When playing tennis the wearer simply turns the hat inside out (FIG. 11 ) and now utilizes a tennis sports pin 28 to secure the cap and hair together.

Thus a new convenience is added by the instant invention for woman's sports hats. The comfort of a hat firmly secured for a variety of sports activities is accomplished in a purposefully attractive symbolic representation of the sport the wearer is enjoying.

While the present invention has been disclosed in connection with versions shown and described in detail, various modifications and improvements thereon will become readily apparent to those skilled in the art. Accordingly, the spirit and scope of the present invention is to be limited only by the following claims.

What is claimed is:

1. A covering for a woman's head, said covering normally being worn out of doors, comprising:

(a) a hat;

(b) said hat having two holes;

(c) said holes being disposed on said hat a spaced distance apart;

(d) a sports pin, said sports pin being configured so as to visually represent an outdoor or sports activity; and (e) said sports pin and said holes being in a cooperative relationship so that when said hat is in position coveting a woman's head, and when said sports pin is inserted into a first hole of said two holes, and through a portion of the hair on the head of the woman, and then out the second hole of said two holes, said hat is firmly secured on the head of a woman, said hat thereby resisting being blown off of the head by windy weather, and resisting falling off of the head due to physical activity, and wherein at least one side of said hat has a logo affixed thereto, said logo representing an outdoor or sports activity.

2. The covering for a woman's head according to claim 1 wherein the edges of said two holes are secured by a grommet being placed within and secured to the edges of each of said holes.

3. The covering for a woman's head according to claim 1 wherein said hat has a crown portion and a brim portion.

4. The covering for a woman's head according to claim 3 wherein said brim is in the form of a peak.

5. The covering for a woman's head according to claim 4 wherein said holes are positioned in said crown a spaced distance above said brim.

6. The covering for a woman's head according to claim 1 wherein said sports pin and said logo visually represent the same outdoor or sports activity.

7. The covering for a woman's head according to claim 6 wherein said holes in said hat denote a front of said hat, and said logo represents the at least one side of said hat.

8. The covering for a woman's head according to claim 6 wherein said sports pin and said logo represent the game of golf.

9. The covering for a woman's head according to claim 6 wherein said sports pin and said logo represent the game of tennis.

10. A covering for a woman's head, said covering normally being worn outdoors, comprising:

(a) a hat, said hat having a crown and a peaked brim;

(b) said crown having two holes adjacent one another positioned a spaced distance above said peaked brim of said hat;

(c) a logo representing an outdoor or sports activity being affixed to at least one side of said crown of said hat;

(d) a sports pin, said sports pin being configured so as to visually represent an outdoor or sports activity; and (e) said sports pin and said holes being in a cooperative relationship so that when said hat is in position covering a woman's head, and when said sports pin is inserted into a first hole of said two holes and through a portion of the hair on the head of a woman, and then out of a second hole of said two holes, said hat is firmly secured on the head of a woman, thereby resisting being blown off of the woman's head by windy weather, and falling off of the woman's head due to physical activity.

11. The covering for a woman's head according to claim 10 wherein said sports pin and said logo represent the same outdoor or sports activity.

12. A covering for a woman's head, said covering normally being worn outdoors, and having an outer covering surface, comprising:

(a) a hat, said hat having a crown portion and a brim portion, said crown portion and said brim portion each including an inner surface and an outer surface;

(b) said hat being reversible between a first position and a second position so that said hat can be turned inside out in order that either the outer surface of said crown and brim or the inner surface of said crown and brim can serve as said outer covering surface of said covering for a woman's head when worn by a woman in said first or second positions, respectively;

(c) each of said outer surface of said crown and said inner surface of said crown having a logo affixed thereto, said logo representing an outdoor or sports activity;

(d) said outer surface of said crown having a first logo representing a first outdoor or sports activity, and said inner surface of said crown having a second logo representing a second outdoor or sports activity;

(e) said crown having two holes adjacent one another positioned a spaced distance above said brim; and (f) at least two sports pins, a first sports pin being configured so as to visually represent the same outdoor or sports activity as said first logo, a second sports pin being configured so as to visually represent the same outdoor or sports activity as said second logo, so that when said hat is in said first or second position covering a woman's head said sports pin representing the same outdoor or sports activity as said logo on the surface of said hat may be inserted into a first hole of said two holes and through a portion of hair on the head of a woman, and then out of a second hole of said two holes, whereby said hat may be firmly secured on the head of a woman, thereby resisting being blown off of the head by windy weather, and resisting falling off of a woman's head due to physical activity.

* * * * *

UNITED STATES PATENT AND TRADEMARK OFFICE

CERTIFICATE OF CORRECTION

PATENT NO. : 5,734,993

DATED : April 7, 1998

INVENTOR(S) : Gail D'Oca

It is certified that error appears in the above-identified patent and that said Letters Patent is hereby corrected as shown below:

IN THE CLAIMS: At column 4, line 23, change the word "covet" to -- cover --.

Signed and Sealed this

Thirtieth Day of June, 1998

*Attest:*

*Attesting Officer*

Bruce Lehman

BRUCE LEHMAN

*Commissioner of Patents and Trademarks*